United States Patent [19]

Takahashi

[11] 3,934,086

[45] Jan. 20, 1976

[54] MATRIX FOUR-CHANNEL DECODING SYSTEM

[75] Inventor: Susumu Takahashi, Tokyo, Japan

[73] Assignee: Sansui Electric Co., Ltd., Tokyo, Japan

[22] Filed: Aug. 16, 1974

[21] Appl. No.: 497,959

[30] Foreign Application Priority Data

Aug. 20, 1973 Japan ..... 48-93097

[52] U.S. Cl. .....179/1 GQ; 179/100.4 ST; 179/100.1 TD

[51] Int. Cl.[2]..... H04R 5/00

[58] Field of Search ..... 179/1 G, 1 GQ, 100.4 ST, 179/100.1 TD, 15 BT

[56] References Cited

UNITED STATES PATENTS

| | | | |
|---|---|---|---|
| 2,904,632 | 9/1959 | Levy | 179/1 G |
| 3,094,587 | 6/1963 | Dow | 179/1 G |
| 3,786,193 | 1/1974 | Tsurushima | 179/100.4 ST |
| 3,825,684 | 7/1974 | Ito et al. | 179/100.4 ST |

*Primary Examiner*—Douglas W. Olms
*Attorney, Agent, or Firm*—Harris, Kern, Wallen & Tinsley

[57] ABSTRACT

To the output side of a matrix four-channel decoder for producing four outputs while controlling the mixing coefficients of left and right composite signals in accordance with the level or instantaneous amplitude relationship between directional audio input signals contained in the composite signals are connected first and second low frequency mixers respectively receiving front pair outputs and back pair outputs. The mixers respectively mix two input signals supplied thereto with each other when they fall within a low frequency range, thereby developing mixed outputs thereof at its two output terminals, and, when they fall within the high frequency range, develop the two input signals at its two output terminals respectively. Each of mixed outputs of the first mixer is a sum of the composite signals while each of the mixed outputs of the second mixer is a difference signal thereof.

3 Claims, 4 Drawing Figures

MATRIX FOUR-CHANNEL DECODING SYSTEM

This invention relates to a matrix four-channel decoding system.

In U.S. Pat. Nos. 3,825,684 and 3,783,192 assigned to the same assignee as the present invention are disclosed matrix fourchannel decoding systems comprising, in order to convert first and second composite signals encoded with at least four directional audio input signals, that is, left-front, right-front, left-back and right-back directional audio input signals in preselected amplitude and phase relationships into left-front, right-front, left-back and right-back output signals, matrix means for producing the output signals by mixing the first and second composite signals with each other, and means for detecting the level relationship between the directional audio input signals contained in the first and second composite signals and controlling the matrix means so as to produce the output signals while varying the mixing coefficients of the first and second composite signals in accordance with the level relationship between the directional audio input signals.

Further, in the copending U.S. application Ser. No. 447,759 filed Mar. 4, 1974 there is proposed for the purpose of obtaining a more natural four-channel reproduction sound a decoding system wherein, only in the intermediate frequency range, the mixing coefficients of the first and second composite signals are controlled in accordance with the level relationship of the directional audio input signals whereas, in the low and high frequency ranges, the mixing coefficients are substantially fixed.

In the decoding system disclosed in the foregoing copending application, the mixing coefficients of the composite signals are so fixed that, in the low frequency range, front pair outputs respectively become a substantial sum signal of the first and second composite signals while rear pair outputs respectively become a substantial difference signal thereof. In the embodiment of the copending application, combinations of gain control amplifiers, CR filter networks and fixed gain amplifiers, the amplifiers and filter networks being adapted to control the coefficients, are used for performing the fixing operation of the mixing coefficients or matrix coefficients of the first and second composite signals.

However, the presence of capacitors or capacitors constituting a filter network in a signal path renders integration circuit version of the decoder apparatus difficult. That is, since it is required for the capacitors to be connected to the integrated circuit block from outside, capacitor-connecting terminals are required. Where such terminals are increased in number, integrated circuit version of the decoder becomes impossible.

An object of the invention is to provide a variable matrix decoding system capable of obtaining a more natural reproduction sound field.

Another object of the invention is to provide a decoding system suitable for integrated circuit conversion.

According to the present invention, to the outputs of matrix means are connected first and second low frequency mixers each having first and second input terminals and first and second output terminals, the first mixer being connected to receive the front pair outputs of the matrix means as first and second inputs and the second mixer the back pair outputs of the matrix means as first and second inputs. Each of the first and second low frequency mixers is operative to develop at the first and second output terminals mixed signals of the first and second input signals when the input signal frequency is in a low frequency range, and develop at the first and second output terminals the first and second input signals respectively when the input signal frequency is in a frequency range higher than the low frequency range.

Each of the mixed outputs developed at the first mixer is a substantial sum signal of the first and second composite signals while each of the mixed outputs developed at the first and second output terminals of the second mixer is a substantial difference signal of the first and second composite signals.

This invention can be more fully understood from the following detailed description when taken in conjunction with the accompanying drawings, in which.

Figure 1:
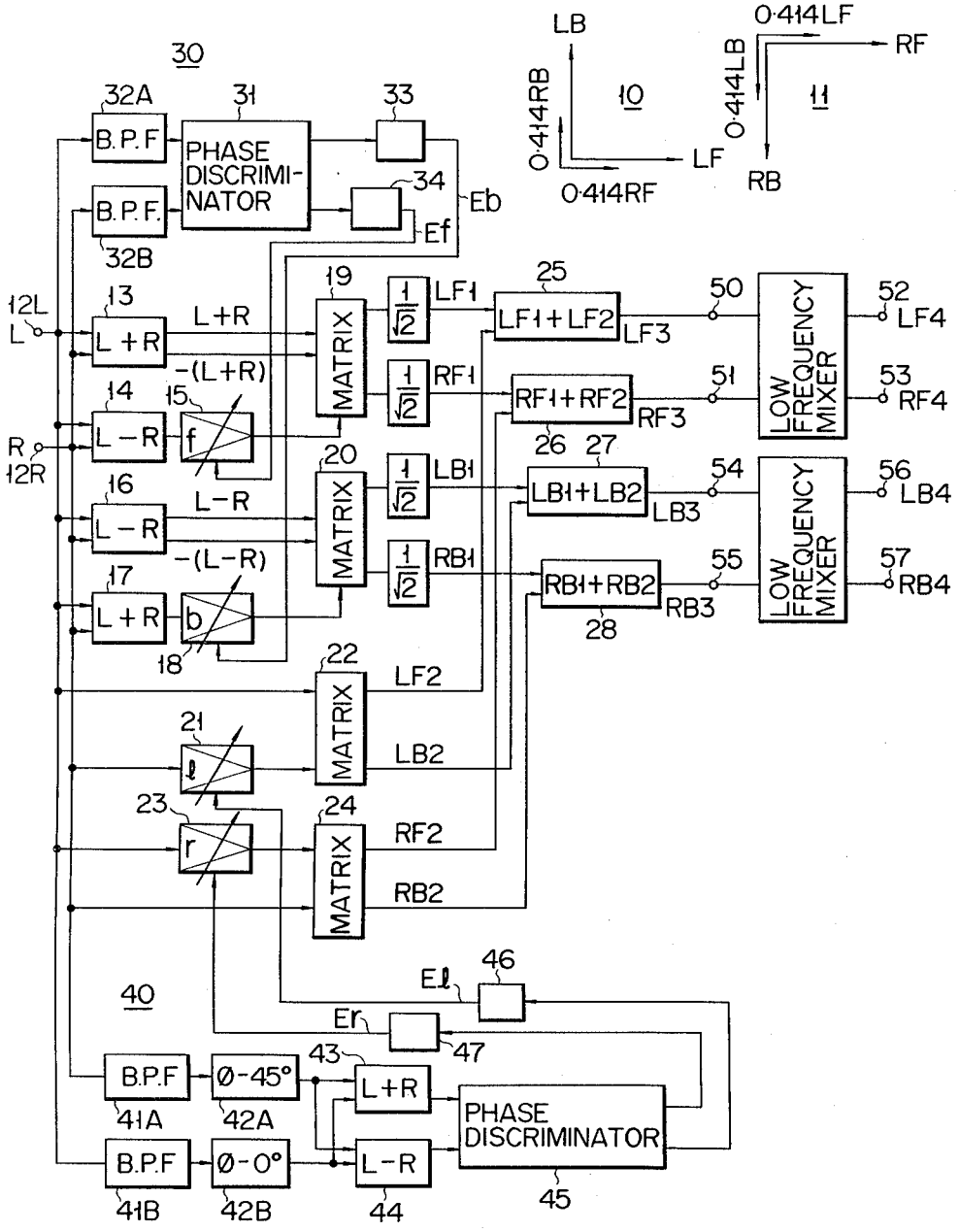
FIG. 1 is a block diagram of a matrix four-channel decoding system according to an embodiment of the invention.

There will now be described by reference to FIG. 1 an embodiment of the decoding system of this invention. Decoder input terminals 12L, 12R receive left and right composite signals L, R containing at least four directional audio input signals LF(left-front), RF(right-front), LB(left-back) and RB(right-back) vectorially composed as indicated at 10, 11, for example. The composite signals L, R are supplied to a matrix circuit 13 to produce two sum signals (L+R), −(L+R). A matrix circuit 14 produces a difference signal L−R, whose amplitude is controlled by a first gain control amplifier 15. A matrix circuit 16 forms two difference signals (L−R), −(L−R). A matrix circuit 17 generates a sum signal (L+R) whose amplitude is controlled by a second gain control amplifier 18. Output signals from the matrix circuit 13 and an output signal from the first gain control amplifier 15 are mixed by a matrix circuit 19 to form a left-front signal LF1 and a right-front signal RF1. Output signals from the matrix circuit 16 and an output signal from the second gain control amplifier 18 are mixed by a matrix circuit 20 to produce a left-back signal LB1 and a right-back signal RB1. The right composite signal R has its amplitude controlled by a third gain control amplifier 21 and is mixed with the left composite signal L by a matrix circuit 22 to form a left-front signal LF2 (L+*l*R) and a left-back signal LB2 (L−*l*R). The left composite signal L has its amplitude controlled by a fourth gain control amplifier 23 and is mixed with the right composite signal R by a matrix circuit 24 to generate a right-front signal RF2 (R+*r*L) and a right-back signal RB2 (R−*r*L). The output signal LF1 from the matrix circuit 19 and the output signal LF2 from the matrix circuit 22 are mixed in the ratio of $(1/\sqrt{2}) : 1$ by a matrix circuit 25 to form a left-front signal LF3.

Right-front signals RF1, FR2 are mixed in the ratio of $(1/\sqrt{2}) : 1$ by a matrix circuit 26 to generate a right-front signal RF3. Left-back signals LB1, LB2 are mixed in the ratio of $(1/\sqrt{2}) : 1$ by a matrix circuit 27 to form a left-back signal LB3. Right back signals RB1, RB2 are mixed in the ratio of $(1/\sqrt{2}) : 1$ by a matrix circuit 28 to form a right-back signal RB3.

The first and second input terminals 12L, 12R are connected to a first control unit 30 which comprises a first phase discriminator 31 supplied with the left and right composite signals L, R through bandpass filters 32A, 32B capable of passing signals having a frequency of 500 Hz to 7 kHz, for example. The first phase discriminator 31 detects the level or instantaneous amplitude relationship or level ratio between the front and back audio input signals contained in the left and right composite signals L, R in accordance with the phase difference between the composite signals L, R and generates two control signals whose voltage levels vary symmetrically in the opposite directions with respect to a reference voltage. These control signals are converted by correction circuits 33, 34 into first and second control signals E*f*, E*b*, in each of which voltage variations in positive and negative directions are unsymmetrical with respect to the reference voltage level. The first control signal E*f* is conducted to the first gain control amplifier 15 to control the amplitude of the difference signal L−R. The second control signal E*b* is supplied to the second gain control amplifier 18 to control the amplitude of the sum signal L+R.

The first and second input terminals 12L, 12R are also connected to a second control unit 40, which comprises band-pass filters 41A, 41B capable of passing signals having a frequency of, for example, 500 Hz to 7 kHz; phase shifters 42A, 42B for introducing between the composite signals L, R a relative phase difference of 45°, for example; matrix circuits 43, 44 for forming sum and difference signals of the composite signals L, R; and a phase discriminator 45 for detecting a phase difference between the sum and difference signals. This second control unit 40 detects the level or instantaneous amplitude relationship or level ratio between the left and right audio input signals contained in the left and right composite signals L, R and generates two control signals whose voltages vary symmetrically in the opposite directions with respect to the reference voltage. The two control signals thus generated are converted by correction circuits 46, 47 into third and fourth control signals E*l*, E*r*, in each of which voltage variations in positve and negative directions are unsymmetrical with respect to the reference voltage. The third control signal E*l* is supplied to the third gain control amplifier 21 to control the amplitude of the right composite signal R. The fourth control signal E*r* is conducted to the fourth gain control amplifier 23 to control the amplitude of the left composite signal L.

In the foregoing embodiment, the first control unit 30 detects the level relationship between the front and back audio input signals contained in the left and right composite signals L, R in accordance with the phase difference between the composite signals L, R. The second control unit 40 detects the level relationship between the left and right audio signals contained in the left and right composite signals L, R in accordance with the phase relationship between the sum and difference signals of the composite signals L, R. However, in order to detect the level relationship between the front and back audio input signals, the first control unit 30 may include a level comparator for detecting the level relationship or ratio between the sum signal L+R and difference signal L−R of the composite signals L, R, and the second control unit 40 may be comprised of a level comparator for detecting the level relationship or ratio between the composite signals L, R in order to detect the level relationship between the left and right audio input signals. Further, the bandpass filters 32A, 32B, 41A, 41B may be replaced by highpass filters capable of passing signals of higher frequency than, for example, 500 Hz.

To the output side of the decoder matrix are connected first and second low frequency mixers 48 and 49. The first mixer 48 has first and second input terminals 50 and 51 connected to receive front pair outputs LF3 and RF3, respectively, and first and second output terminals 52 and 53 at which are developed front output signals LF4 and RF4 coupled to front pair loudspeakers, respectively. Similarly, the second mixer 49 has first and second input terminals 54 and 55 connected to receive back pair outputs LB3 and RB3, respectively, from the decoder, and first and second output terminals 56 and 57 at which are developed back output signals LB4 and RB4 coupled to back pair loud-speakers, respectively.

The first and second low frequency mixers 48 and 49 respectively are so constructed that where first and second input signals applied to the first and second input terminals have a low frequency, mixed outputs of the first and second input signals are developed at the first and second output terminals whereas where the input signals have a high frequency, they are developed at the first and second output terminals, respectively.

The output signals LF3, RF3, LB3 and RB3 of the decoder matrix in FIG. 1 respectively are expressed by the operation equations:

$$LF3 = LF1 + LF2 = 1/\sqrt{2}\{(L+R) + f(L-R)\} + L + lR = 1\sqrt{2}\{(1+f+\sqrt{2})L + (1-f+2l)R\} \quad (1)$$

$$RF3 = RF1 + RF2 = 1\sqrt{2}\{(L+R) - f(L-R)\} + R + rL = 1/\sqrt{2}\{(1+f+\ 2)R + (1-f+\sqrt{2}r)L\} \quad (2)$$

$$LB3 = LB1 + LB2 = 1/\sqrt{2}\{(L-R) + b(L+R)\} + L - lR = 1/\sqrt{2}\{(1+b+\sqrt{2})L - (1-b+\sqrt{2}l)R\} \quad (3)$$

$$RB3 = RB1 + RB2 = 1/\sqrt{2}\{-(L-R) + b(L+R)\} + R - rL = 1/\sqrt{2}\{(1+b+\sqrt{2})R - (1-b+\sqrt{2}r)L\} \quad (4)$$

where *f*, *b*, *l* and *r* respectively represent variable matrix coefficients and correspond to the respective gain coefficients of the gain control amplifiers 15, 18, 21 and 23.

As described in the foregoing copending application, where it is desired to obtain a sum signal of the composite signals L and R as the front pair outputs LF3 and RF3 and a difference signal of the composite signals as the back pair outputs LB3 and RB3 it is necessary to fix the variable matrix coefficients *f* and *b* to "0" and the coefficients *l* and *r* to "1". However, to obtain the relationship of $f = b = 0$ and $r = l = 1$ in the low frequency range, CR filter networks and fixed gain amplifiers are required as stated in the copending application. The presence of capacitors in the filters renders integrated circuit version of the decoder matrix very difficult.

This invention is based on the following fact. Namely, adding the equation (1) to the equation (2), the following equation is obtained.

$$LF3 + RF3 = (\sqrt{2}+1)(L+R) + lR + rL \quad (5)$$

Further, subtracting the equation (4) from the equation (3), the following equation is obtained.

$$LB3 - RB3 = (\sqrt{2}+1)(L-R) + rL - lR \quad (6)$$

As apparent from the equations (5) and (6), if $r = l = 0$, the aforesaid addition produces a sum signal of the composite signals L and R while the aforesaid subtraction produces a difference signal thereof.

Accordingly, if, in the decoder of FIG. 1, the gain coefficients $f$, $b$, $l$ and $r$ of the gain control amplifiers 15, 18, 21 and 23 are fixed to substantially zero in the low frequency range, the first mixer 48 is operative to develop, in the low frequency range, a sum signal of the input signals LF3 and RF3 at the first and second output terminals 52 and 53, and the second mixer 49 is operative to develop a difference signal of the input signals LB3 and RB3 at the first and second output terminals 56 and 57, then the same results as in the case where the relationship of $f = b = 0$ and $r = l = 1$ in the aforesaid copending application is established will be obtained.

Figure 2:
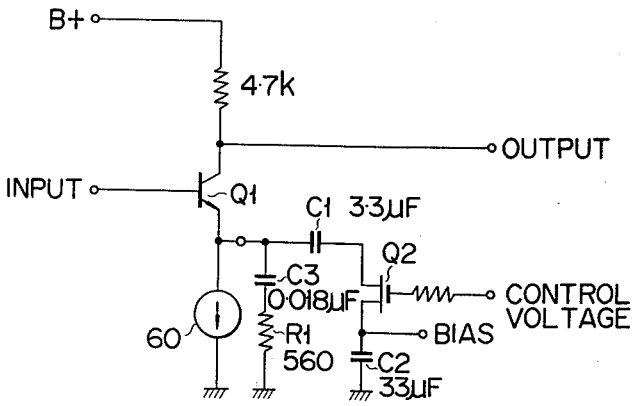
FIG. 2 is a circuit diagram of one example of gain control amplifiers used in FIG. 1 and suitable for integrated circuit version.

A suitable example of the gain control amplifier is illustrated in FIG. 2. The emitter at an amplifying transistor Q1 is grounded via a current source 60. A series circuit of a capacitor C1, the drain-source path of a field effect transistor Q2 a capacitor C2, and a series circuit of a capacitor C3 and resistor R1 are connected in parallel with the current source 60 in an integrated circuit of the decoder matrix, the capacitors C1, C2 and C3, resistor R1 and transistor Q2 are provided exteriorly of the integrated matrix circuit block.

The gain of the transistor Q1 is determined substantially by the ratio of the collector resistance / the emitter resistance. A resistance value between the drain and source of the transistor Q2 is varied in response to the control voltage applied to the gate thereof thereby to control the gain of the transistor Q1. Where the capacitor C1 has as small a value as, for example, 3.3 microfarads, it exhibits a high impedance in the range of low frequency, so that the field effect transistor Q2 is electrically disconnected from the emitter circuit of the transistor Q1. Accordingly, the gain of the transistor Q1, in the range of low frequency, is determined by a high resistance of the current source 60 and the resistance of the collector and is rendered substantially zero. The capacitor C3 and the resistor R1 are provided for the purpose of causing the transistor Q1 to have a relatively high gain in the range of high frequency without being affected by the field effect transistor Q2. Since, however, provision of the capacitor C3 and resistor R1 causes the transistor Q1 to have an unnecessarily high gain in the range of high frequency, it is desirable to provide limiter circuits for limiting the amplitude of a high frequency signal on the input or output side of the decoder thereby to substantially fix the gain in the decoder relative to such high frequency signal.

Figure 3:
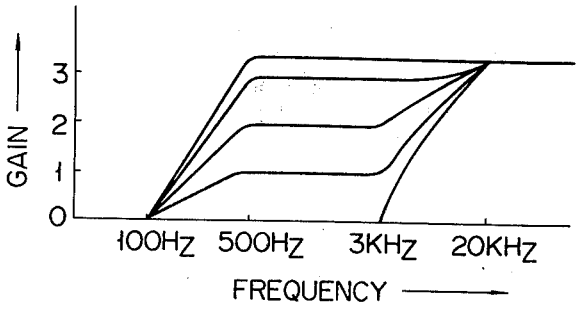
FIG. 3 shows the characteristics of the gain control amplifiers of FIG. 2.

FIG. 3 shows the frequency characteristic of the gain control amplifier of FIG. 2 obtained in the case where limiter circuits, which may each be a series circuit of a capacitor and resistor for limiting the amplitude of the high frequency component of the composite signals L and R are provided on the input side of the decoder. It is apparently understood from FIG. 3 that the gain control amplifier is so operated as to more widely control the amplitude of an intermediate frequency input signal than that of low and high frequency input signals.

Figure 4:
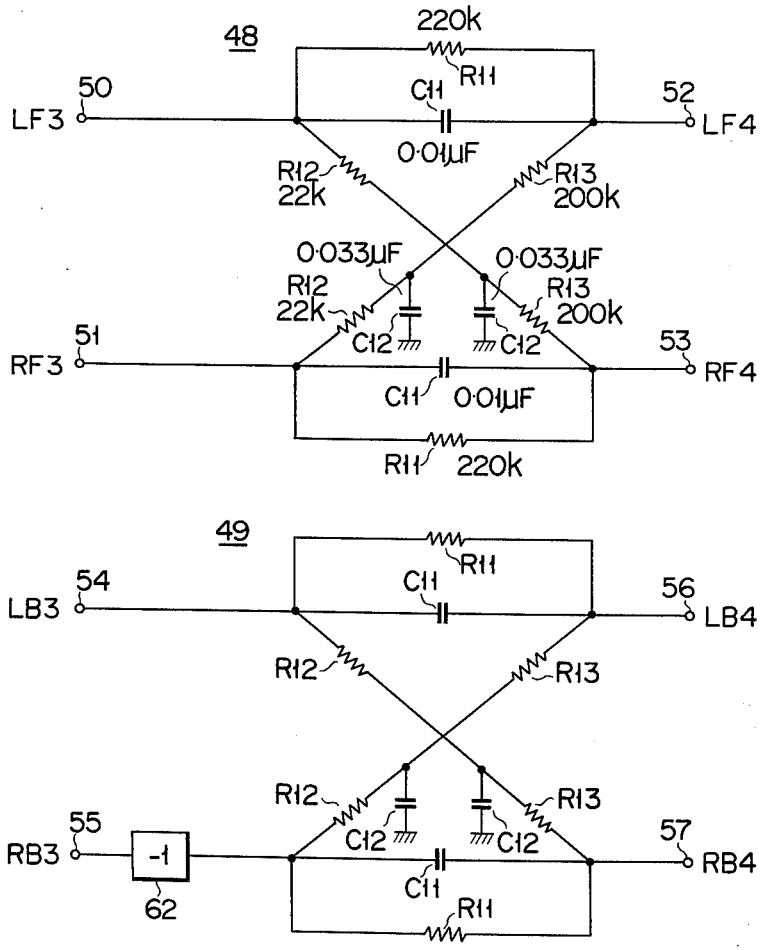
FIG. 4 is a circuit diagram of the low frequency mixers of FIG. 1.

A preferred circuit arrangement of the first and second low frequency mixers 48 and 49 is illustrated in FIG. 4. In the first mixer 48, two parallel circuits each consisting of a resistor R11 and capacitor C11 are connected between the first input terminal 50 and the first output terminal 52 and between the second input terminal 51 and the second output terminal 53 respectively. Two series circuits each consisting of resistors R12 and R13 are connected between the first input terminal 50 and the second output terminal 53 and between the second input terminal 51 and the first output terminal 52, respectively. A capacitor C12 is connected between the junction of the resistors R12 and R13 of each of the series circuits and ground. The respective values of the resistors R11, R12 and R13 are determined so that the resistance value of R11 is substantially equal to a sum of the resistance values of R12 and R13. Further, it is desirable to make the resistance value of R12 substantially equal to the output impedance value of the decoder matrix for the reason as described hereinafter. The second mixer 49 is constructed similarly to the first mixer 48. Where the decoder outputs LB3 and RB3 are expressed as by the foregoing equations (3) and (4) an inverter 62, in order to perform subtraction of RB3 from LB3, is connected, for example, between the second input terminal 55 and the parallel circuit of the capacitor C11 and resistor R11. However, where the decoder matrix is constructed to produce an output corresponding to −LB3 or −RB3, provision of the inverter 62 is unnecessary.

The operation of the mixers will hereinafter be described. In the low frequency range within which the capacitors C11 and C12 exhibit a high impedance, the first mixer 48 is operative to mix the decoder outputs LF3 and RF3 by the resistors R11 and the series connected resistors R12 and R13 thereby to develop mixed outputs of the decoder outputs LF3 and RF3, that is, a sum signal of the composite signals L and R at the first and second output terminals 52 and 53, respectively. On the other hand, the second mixer 49 develops mixed outputs of the decoder outputs LB3 and RB3, that is, a difference signal of the composite signals L and R at the first and second output terminals 56 and 57, respectively. In the high frequency range within which the capacitors C11 and C12 present a low impedance with each of the first and second mixers, first and second input signals applied to the first and second input terminals appear respectively at the first and second output terminals with little mixing of the input signals. For example, the decoder output LF 3 is attenuated by a low-pass filter consisting of R12 and capacitor C12, and is further attenuated by an attenuator consisting of the resistor R13, the capacitor C11 and a decoder output impedance at the second input terminal 51. As the result, the high frequency output LF3 little appears at the second output terminal 53. When the crosstalk of the output LF3 from the input terminal 50 to the output terminal 53 at a frequency of 100 Hz is 0 db, the crosstalk at a frequency of 1 kHz can be reduced to below −20 db.

The level of respective signals appearing at the respective output terminals is lowered by −6 db due to the mixing operation of the first and second mixers 48 and 49 in the range of low frequency. For this reason, it is considered that signal levels in the low frequency range are more lowered than those in the high frequency range. However, by rendering the resistance value of the resistor R12 substantially equal to the value of the decoder output impedance a −6db attenuator consisting of the decoder output impedance and the resistor R12 is formed relative to high frequency signals. Accordingly, the frequency characteristics of the first and second mixers 48 and 49 can be rendered substantially flat.

In the preceding embodiment, the first and second mixers 48 and 49 are respectively formed by a resistor-capacitor combination but may be formed by differential amplifiers.

By parallel-connecting the capacitor to the common emitter of paired transistors constituting a differential amplifier, it is possible to operate the paired transistors as a differential amplifier in the range of low frequency and on the other hand to operate the paired transistors as two independent amplifiers in the range of high frequency. Where differential amplifiers are used, one of the decoder outputs LF3 and RF3 is coupled to one input terminal of one differential amplifier, and the other of the decoder outputs LF3 and RF3 is coupled to the other input terminal via an inverter. To the paired input terminals of the other differential amplifier are coupled the decoder outputs LB3 and RB3.

What is claimed is:

1. In a matrix four-channel decoding system for converting first and second composite signals encoded with at least left-front, right-front, left-back and right-back directional audio input signals in preselected amplitude and phase relationships into left-front, right-front, left-back and right-back output signals, comprising matrix means for producing said output signals by combining said first and second composite signals, and means for detecting the level relationship between the directional audio input signals contained in said first and second composite signals and controlling said matrix means so as to produce said output signals while varying the mixing coefficients of said first and second composite signals in accordance with the instantaneous amplitude relationship between said directional audio input signals, said matrix four-channel decoding system comprising first and second mixers each having first and second input terminals and first and second output terminals, said first mixer being connected to receive the left-front and right-front output signals from said matrix means at said first and second input terminals of said first mixer, respectively, for developing, when the first and second composite signals are in a first frequency range, a sum of the left-front and right-front output signals which is substantially a sum of the first and second composite signals at each of said first and second output terminals of said first mixer, and, when the first and second composite signals are in a second frequency range above the first frequency range, the left-front and right-front output signals at said first and second output terminals of said first mixer, respectively, and said second mixer being connected to receive the left-back and right-back output signals from said matrix means at said first and second input terminals of said second mixer, respectively, for developing, when the first and second composite signals are in the first frequency range, a difference of the left-back and right-back output signals which is substantially a difference of the first and second composite signals at each of said first and second output terminals of said second mixer, and, when the first and second composite signals are in the second frequency range, the left-back and right-back output signals at said first and second output terminals of said second mixer, respectively.

2. A matrix four-channel decoding system as set forth in claim 1 wherein each of said first and second mixers comprises first and second resistor-capacitor networks connected between said first input terminal and said first output terminal and between said second input terminal and said second output terminal, respectively, and each having a first resistor and a first capacitor connected in parallel with each other; and third and fourth resistor-capacitor networks connected between said first input terminal and said second output terminal and between said second input terminal and said first output terminal, respectively, and each having second and third resistors connected in series and a second capacitor connected between the junction of said second and third resistors and a reference potential point.

3. A matrix four-channel decoding system as set forth in claim 2 wherein the resistance value of said first resistor is substantially equal to a sum of the resistance values of said second and third resistors.

* * * * *